United States Patent [19]

Kinsella

[11] 4,080,154

[45] Mar. 21, 1978

[54] GAS BURNER CONTROL SYSTEM WITH CYCLING PILOT

[75] Inventor: Howard R. Kinsella, St. Louis County, Mo.

[73] Assignee: Emerson Electric Co., St. Louis, Mo.

[21] Appl. No.: 749,724

[22] Filed: Dec. 13, 1976

[51] Int. Cl.[2] ..... F23Q 9/08

[52] U.S. Cl. ..... 431/43; 431/58; 137/65

[58] Field of Search ..... 431/43, 44, 45, 51, 431/53, 58; 137/65, 66; 236/15 A

[56] References Cited

U.S. PATENT DOCUMENTS

| | | | |
|---|---|---|---|
| 3,711,236 | 1/1973 | Kinsella | 431/53 |
| 3,905,747 | 9/1975 | Branson | 431/58 |
| 3,938,936 | 2/1976 | Vizmeg | 431/51 |

*Primary Examiner*—Edward G. Favors
*Attorney, Agent, or Firm*—Charles E. Markham

[57] ABSTRACT

In a gas burner control system a normally closed, electromagnetically opened first valve has primary control of gas flow to pilot and main burners and the application of gas pressure to cause a normally closed, diaphragm-operated second valve controlling gas flow to a main burner to open; the first valve opens and a spark igniter becomes operative to ignite the pilot upon closure of a space thermostat. A thermostatically operated switch heated by pilot flame has a cold position through which a circuit to open the first valve is completed and a hot position through which a circuit causing the diaphragm-operated second valve to open is completed. A holding circuit paralleling the switch is effective to hold the first valve open when the switch moves to its hot position, but is ineffective to open it, so that upon failure of the electrical power supply, the first primary control valve will not open until the switch has cooled to its cold position.

4 Claims, 1 Drawing Figure

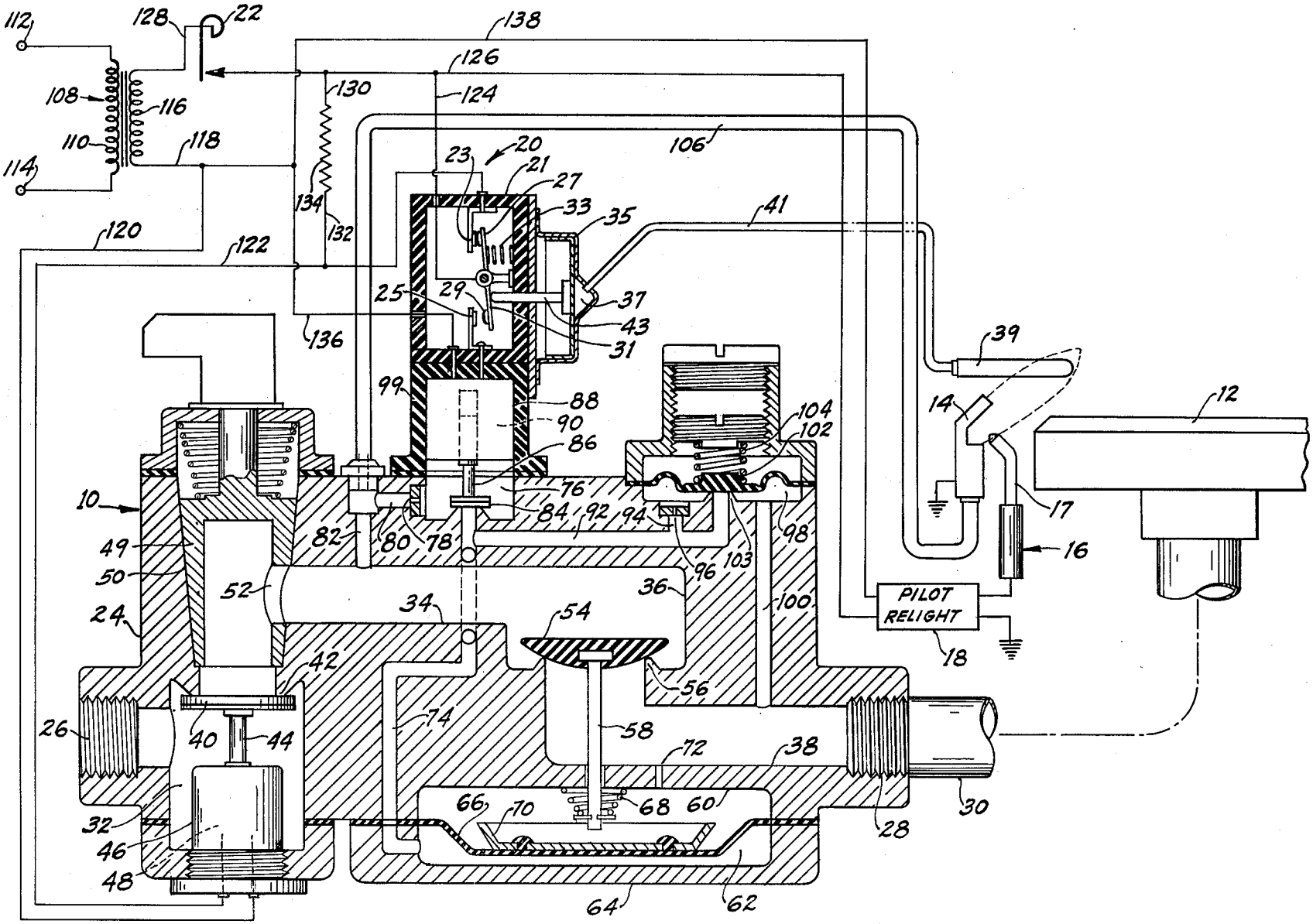
PILOT
RELIGHT

GAS BURNER CONTROL SYSTEM WITH CYCLING PILOT

BACKGROUND OF THE INVENTION

This invention relates to electrically operated control systems for gas burners in which a pilot burner is cycled on and off with the closing and opening of a space thermostat and gas flow to a main burner is effected by thermostatic means heated by pilot flame and, particularly, to a system of this kind in which the re-institution of gas flow to a main burner following the cut off thereof due to electrical power failure and prior to the assured re-establishment of an adequate pilot flame is precluded.

The U.S. Pat. No. 3,975,135 discloses a gas burner control system in which a normally closed, electromagnetically operated valve 76 controls gas flow to a pilot burner 14 and the application of gas pressure to the diaphragm chamber 46 of a normally closed diaphragm operated valve 38. The valve 76 opens and a spark igniter 16 becomes operative to ignite the pilot burner upon closure of a space thermostat 20. Intermediately of electromagnetic valve 76 and diaphragm chamber 46 is a thermostatically operated valve 74 having an expanding fluid-type thermostatic actuator including a bulb 100, which when sufficiently heated by pilot flame causes valve 74 to open and admit gas pressure to open valve 38.

In this arrangement, it will be seen that if the electrical power supply fails the electromagnetic valve 76 will instantly close, cutting off gas flow to pilot burner 14 and cutting off the application of gas pressure to diaphragm chamber 46. As a result, the flame at the pilot burner 14 and main burner 12 will be extinguished immediately. The diaphragm chamber 46 exhausts through orifice 82, permitting valve 12 to close rapidly. The thermostatically operated valve 74 will not, however, close immediately as a result of power failure. Some period of time is required for the fluid in bulb 100 and the chamber 98 to cool and contract or condense sufficiently, following extinguishing of the pilot flame, to permit the biasing spring 106 to close valve 74.

If the electrical power supply failure is only momentarily and is restored in a matter of a few seconds, which frequently occurs, the valve 74 will still be open when power is restored. As a result, valve 76 will open instantly upon restoration of power and main diaphragm valve 38 will open immediately, causing a large amount of gas to flow into the burner combustion chamber. At the same time, gas will flow to the pilot burner and the spark igniter will begin operation. The safe operation of gas burners, particularly the main burners of central heating systems provided with pilot burners, requires that an adequate pilot flame be established prior to the admission of gas flow to the main burner to insure instant ignition under any conditions which may occur in operation. Even a slight delay in the establishment of pilot flame when fuel is flowing from a main burner presents a potentially hazardous condition in systems designed to operate with a pilot burner.

An object of the present invention is to provide an improved gas burner control system employing a cycling pilot burner with thermostatic means heated by pilot burner flame for controlling gas flow to a main burner, in which means is provided to insure the establishment of adequate pilot flame under all conditions of operation prior to admission of gas flow to the main burner.

Further objects and advantages will appear from the following description when read in connection with the accompanying drawing.

The single FIGURE of the drawing is a schematic illustration of a gas burner control system constructed in accordance with the present invention.

Referring to the drawing, the system includes as primary elements, a manifold gas valve device generally indicated at 10, a main burner 12, a pilot burner 14, a spark igniter 16 comprising an electrode 17 and pulse generating means 18, a thermostatically actuated switch 20, and a space thermostat 22.

The manifold valve device 10 comprises a body 24 having an inlet 26 adapted to receive a gas supply conduit and an outlet 28 receiving a gas conduit 30 leading to a main burner 12. A main fuel passageway means including a chamber 32, a hollow rotary plug cock 49, a passage 34, a chamber 36 and a passage 38 connects inlet 26 with outlet 28.

A biased closed, electromagnetically opened, primary control valve 40 in chamber 32 cooperates with an annular valve seat 42 formed at the outlet of chamber 32 to control all flow through the manifold valve device 10. The valve 40 has a stem 44 connecting it to the plunger of a solenoid 46 having a winding 48. In axial vertical alignment with the valve 40 and valve seat 42 is a tapered hollow rotary plug cock 49. Plug cock 49 is seated in a vertical tapered bore 50 in body 24 and has a port 52 in the side wall thereof arranged for registry with passage 34.

A secondary, biased closed, gas pressure opened valve 54 cooperating with an annular valve seat 56 formed at the outlet of chamber 34 controls gas flow to outlet passage 38 and main burner 12. Valve 54 has a stem 58 extending downward into a diaphragm chamber comprising an upper portion 60 formed as a cavity in body 24 and a lower portion 62 formed by a cup-shaped member 64 attached to the body 24. A flexible diaphragm 66 clamped at its periphery between body 24 and cup member 64 divides the diaphragm chamber into the upper and lower portions 60 and 62. Valve 54 is biased downward in a closed position on its seat 56 by a spring 68. Flexible diaphragm 66 has a relatively rigid centrally located circular member 70 arranged to engage the lower end of valve stem 50 and move valve 54 upward toward an open position when sufficient gas pressure is applied to the lower side of diaphragm 66.

The upper portion 60 of the diaphragm chamber is vented to outlet passage 38 through a vent 72. The lower portion 62 of the diaphragm chamber communicates with inlet 26 through a passage 74, a valve chamber 76, an orifice 78, passages 80 and 82, passage 34, hollow plug cock 49, and chamber 32. There is a biased closed, electromagnetically opened valve 84 cooperating with an annular valve seat 85 surrounding the entry of passage 74 into valve chamber 76 to control the admission of inlet gas to lower diaphragm chamber portion 62. Valve 84 has a stem 86 connecting it to the plunger of a solenoid 88 which has a winding 90.

The gas pressure in lower diaphragm chamber portion 62, which is applied to the lower side of diaphragm 66, is always something less than the supply pressure at inlet 26 due to the pressure dropping orifice 78 and because of a constant and variable bleed off from passage 74 to outlet passage 38 through branch passageway means. This branch passageway means comprises passages 92 and 94, orifice 96, valve chamber 98, and a passage 100 to outlet passage 38. Means for varying the bleed-off rate through branch passage 92 in response to outlet pressure variations, so as to maintain some predetermined constant outlet pressure, comprises a diaphragm-type, pressure regulator valve 102 biased toward a closed position on an annular valve seat 103 by an adjustable spring 104. A relatively small, predetermined, constant bleed off is also provided, for a purpose to be described, by the passage 94 and orifice 82 which bypass the pressure regulator valve 102.

Gas is supplied to pilot burner 14 through passage 82 and a conduit 106 where it is ignited by spark igniter 16. Sparking occurs between igniter electrode 17 and conductive metal pilot burner 14, which is grounded. The pulse generating means 18 for producing high voltage pulses at a desired frequency may be of any suitable construction and arrangement and preferably includes means responsive to the occurrence of pilot flame to cut off sparking. Pulse generating means of this kind is disclosed in U.S. Pat. No. 3,894,273.

The thermostatically actuated, double throw switching device 20 comprises a casing 21 which for convenience of illustration is shown mounted on a casing 99 enclosing solenoid 88. A pair of stationary contacts 23 and 25 in switch 20 cooperate with a pair of movable contacts 27 and 29, respectively, to complete and break circuits to be described. The movable contacts are mounted on opposite ends of an intermediately pivoted switch blade 31 and alternately engage their respective stationary contacts. A spring 33 biases movable contact 27 against stationary contact 23 when switching device 20 is in a cold position. An expansible chamber 35 comprising an inner flexible metal cup and an outer rigid metal cup is attached to the side of switch casing 21. A space 37 between the cup elements is connected to a bulb mounted adjacent pilot burner 14 by a capillary tube 41. The expansible chamber 35, the capillary tube 41, and bulb 39 comprise a sealed system containing a thermally expansible fluid such as mercury, with bulb 39 positioned so as to be impinged by pilot flame.

An actuator rod 43 bearing at one end against the inner flexible cup member of expansible chamber 35 and at its other end against pivoted switch blade 31 rotates the switch blade clockwise against biasing spring 33, causing contact 27 to break from contact 23 and contact 29 to make with contact 25. When this occurs switch 20 is in a hot position.

ELECTRICAL CONNECTIONS

A voltage step-down transformer 108 includes a primary coil 110 connected across a pair of a.c. power supply terminals 112 and 114 and a secondary coil 116. When thermostatically actuated switch 20 is in a cold position, with contacts 23–27 closed, the winding 48 of solenoid 46 is connected across transformer secondary coil 116 through leads 118, 120 and 122, stationary contact 23 and movable contact 27, a lead 124 connected to switch blade 31, a lead 126, space thermostat 22, and a lead 128. A holding circuit for solenoid winding 48 paralleling switch 20 and comprising leads 130 and 132 and a resistor 134 also connects the winding across the transformer secondary 116. The resistor 134 is of such value as to result in sufficient energization of solenoid winding 48 to hold valve 40 open once it is open and the solenoid plunger is in an atrracted position, but limits energization of winding 48 to a value which is insufficient to open valve 40 from its biased closed position.

When thermostatic switching device 20 is moved to a hot position, with contacts 25–29 closed, the winding 90 of solenoid 88 is connected across the transformer secondary 116 through leads 118 and 136, contacts 29–25, leads 124 and 126, thermostat 122 and lead 128. This causes valve 84 to open when space thermostat 22 is closed. Also, when thermostat 22 is closed, the igniter pulse generating means 18 is connected across transformer secondary 116 by leads 118, 138, 126, and 128 causing operation of the igniter.

OPERATION

The system is shown in a cold position with electromagnetically operated valves 40 and 84 and diaphragm operated valve 54 all biased closed and thermostatic switching device 20 in a cold position, but with plug cock 49 rotated to open position. Under these conditions, when space thermostat 22 closes, the solenoid winding 48 is instantly energized sufficiently through contacts 23–27 to open valve 40 and igniter 16 will instantly become operative. Gas will now flow to pilot burner 14 and be ignited by igniter 16. When the fluid in bulb 39 becomes sufficiently heated by pilot flame to expand expansible chamber 35 to cause switch contacts 23–27 to open and cause contacts 25–29 to close, the electromagnetically operated valve 84 will be opened. Valve 40 will remain open due to the holding circuit 130–132 and 134.

The opening of valve 84 permits gas to flow to lower diaphragm chamber portion 62, increasing the pressure therein and causing valve 54 to be opened. Gas will now flow to main burner 12 to be ignited by pilot burner flame. The pressure in lower diaphragm chamber portion 62 and, consequently, the degree of opening of valve 54 will be regulated by regulator valve 102 to maintain some predetermined outlet pressure in passage 38. The main burner 12 and pilot burner 14 will continue to burn until thermostat 22 opens, whereupon electromagnetic valves 40 and 84 instantly close and valve 54 closes immediately thereafter. When valves 40 and 84 close, the existing pressure in lower diaphragm chamber portion 62 immediately exhausts to outlet 28 through passages 74, 92, and 94, orifice 96, chamber 98, and passage 100, permitting immediate closure of valve 54 under the bias of spring 68. The orifice 78 at the entrance of valve chamber 76 is sufficiently larger than the constant bleed-off orifice 96 to maintain sufficient operating pressure in diaphragm chamber 62 when valve 84 is open. The purpose of orifice 78 is to limit the operating pressure to a range wherein the pressure regulator valve 102 will operate accurately.

It will be seen that if upon starting burner operation from a cold position in response to closure of space thermostat 22 the pilot burner fails to ignite and provide an adequate flame to heat bulb 39, the switch 20 will remain in a cold position and valve 84 and, consequently, diaphragm operated valve 54 will remain closed so that no gas flows to the main burner. It will also be seen that if during normal burner operation the electrical power supply fails, causing valves 40, 54, and 84 to close and extinguishing pilot and main burner flame, the primary control valve 40 will not reopen upon resumption of electrical power until the thermostatic switch 20 has cooled sufficiently to close contacts 23–27. The simultaneous flow of unignited gas to the pilot and main burners upon restoration of electrical power following a short period of power failure is thereby prevented.

I claim:

1. In a gas burner control system;

a space thermostat;

an electrical power source;

a main burner;

a pilot burner arranged to ignite said main burner;

an electrically operated igniter arranged to ignite said pilot burner;

a manifold valve device comprising a body having an inlet for connection with a gas supply, an outlet for connection with said main burner, and a main gas passageway connecting said inlet and outlet;

a first, biased closed, electromagnetic valve in said main gas passageway;

a biased closed, pressure operated valve in said main gas passageway downstream from said first electromagnetic valve;

an expansible chamber operatively connected to said pressure operated valve and operative to open said valve when said chamber is in communication with said inlet;

a first branch passage leading from said main passageway at a point between said first electromagnetic valve and said pressure operated valve for connection with said pilot burner;

a second branch passage leading from said main passageway at a point between said first electromagnetic valve and said pressure operated valve to said expansible chamber;

a second, biased closed, electromagnetic valve in said second branch passage;

a double throw, thermostatically actuated switch having a cold position and a hot position and including means biasing the switch in its cold position;

a thermostatic actuator arranged to be heated by pilot flame and operative when sufficiently heated to move said switch from its biased cold position to its hot position;

electrical circuit means completed through said space thermostat rendering said igniter operative;

electrical circuit means completed through said space thermostat and said switch when in its cold position operative to energize said first electromagnetic valve sufficiently to open it from its biased closed position;

electrical holding circuit means including impedance means bypassing said switch and completed through said space thermostat for energizing said first electromagnetic valve sufficiently to hold it open but insufficiently to open it from a biased closed position;

electrical circuit means completed through said space thermostat and said switch when in its hot position operative to cause said second electromagnetic valve to open; and means for exhausting said expansible chamber to permit closure of said pressure operated valve when said first or second electromagnetic valve closes.

2. The gas burner control system claimed in claim 1 in which the means for exhausting said expansible chamber comprises a constant vent extending from said expansible chamber to said outlet.

3. The gas burner control system claimed in claim 1 which further includes a bleed-off passageway leading from said second branch passage to said outlet and including a pressure regulator valve responsive to the pressure existing at said outlet to vary the bleed-off rate.

4. The gas burner control system claimed in claim 1 which further includes a rotary plug cock in said main passageway between said first electromagnetic valve and said pressure operated valve.

* * * * *